US006379511B1

(12) United States Patent
Fatula et al.

(10) Patent No.: US 6,379,511 B1
(45) Date of Patent: Apr. 30, 2002

(54) PADDLE DESIGN FOR PLATING BATH

(75) Inventors: Joseph J. Fatula; Robert M. Browne, both of San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/401,756

(22) Filed: Sep. 23, 1999

(51) Int. Cl.[7] ..... C25D 17/00
(52) U.S. Cl. ..... 204/222
(58) Field of Search ..... 204/222

(56) References Cited

U.S. PATENT DOCUMENTS 4,428,814 A * 1/1984 Chen ..... 204/273
4,587,000 A * 5/1986 Pelligrino et al. ..... 204/273
5,312,532 A * 5/1994 Andricacos et al. ..... 204/231
5,516,412 A * 5/1996 Andricacos et al. .... 204/224 R
6,071,388 A * 6/2000 Uzoh ..... 204/297 R

* cited by examiner

*Primary Examiner*—Kathryn Gorgos
*Assistant Examiner*—Erica Smith-Hicks
(74) *Attorney, Agent, or Firm*—Robert B. Martin; Bracewell & Patterson, L.L.P.

(57) ABSTRACT

An electroplating system circulates solution between an anode and a workpiece mounted to a cathode. A shaped agitation paddle is reciprocated immediately adjacent to the cathode workpiece to improve performance of the system. The paddle is an elongated prism having a generally flat side that is parallel to the workpiece. The flat side has a fluid port connected to a pump. The solution may be pumped with either positive pressure to force the solution against the surface of the workpiece, or negative pressure to draw the solution away from the surface of the workpiece. In an alternate embodiment, the cathode workpiece is rotated in the solution above an anode with a stationary, shaped paddle in between them.

29 Claims, 2 Drawing Sheets

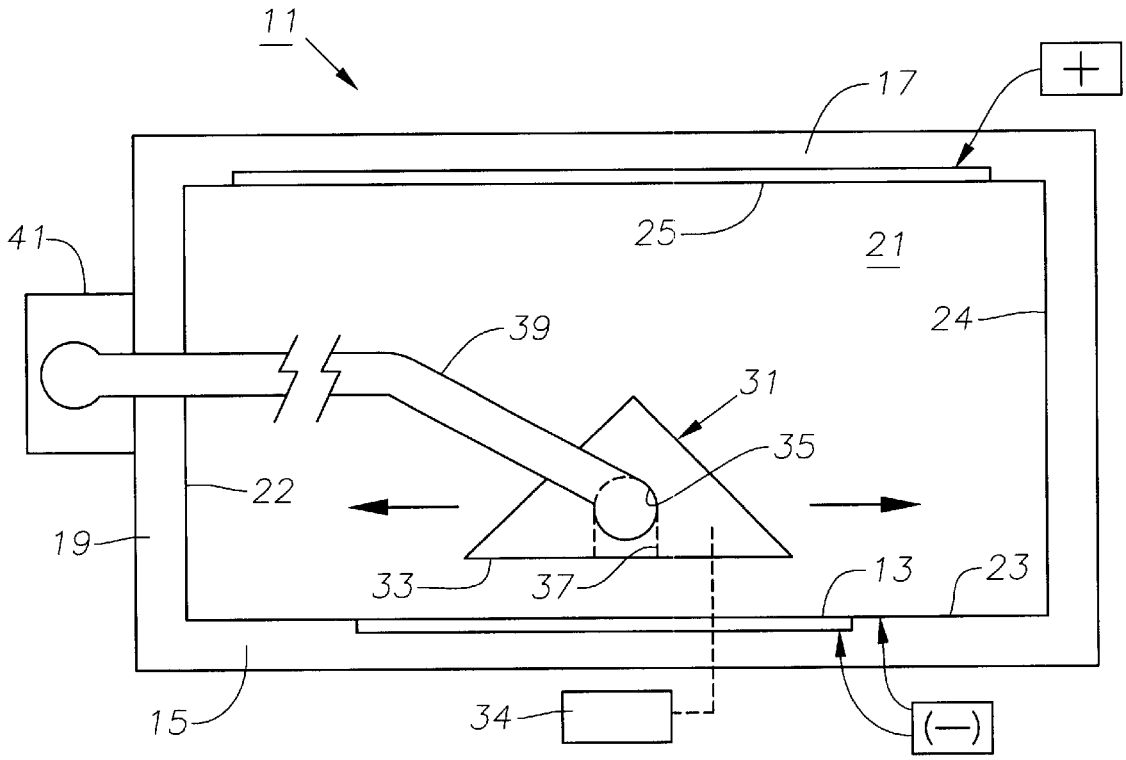
Fig. 1
Fig. 2
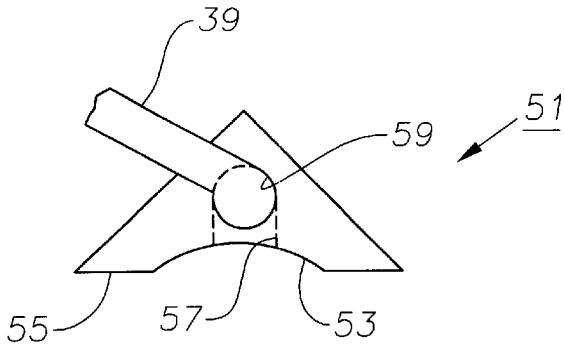
Fig. 3
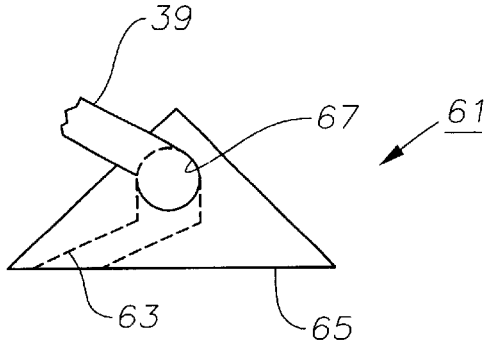

PADDLE DESIGN FOR PLATING BATH

BACKGROUND OF THE INVENTION

1. Technical Field

This invention relates in general to electroplating and etching, and in particular to an apparatus and method for controlling the thickness, uniformity, and composition of electroformations.

2. Background Art

In electroplating, a thin film of metal or alloy is deposited on a workpiece that is submerged in an electrolytic bath. The workpiece acts as a cathode when connected to the negative terminal of a power supply. An anode is similarly submerged and connected to the positive terminal of the power supply. Electrical current flows between the anode and the cathode through the electrolyte, and metal is deposited on the workpiece through an electrochemical reaction.

It is highly desirable to deposit the metal on the workpiece at a uniform thickness and composition, especially with electrical component workpieces. However, electroplating is relatively complex and various naturally occurring forces may degrade the process. In particular, the current or flux path between the anode and cathode should be relatively uniform to ensure uniform deposition. In addition, as metal ions are depleted from the electrolyte, its uniformity is decreased and must be adjusted to avoid degradation of the process. Furthermore, debris is generated in the chemical reactions that also can degrade the process.

In the prior art, uniformity and consistency in electroplating has been achieved by several methods. In U.S. Pat. No. 5,312,532, an electroplating system circulates solution between horizontally-disposed anodes and workpiece cathodes in multiple compartments. The workpiece cathodes are located on the floors of the compartments and the anodes are located above the cathodes. A horizontally-oriented paddle is reciprocated in a horizontal plane between the terminals and slightly above the cathode workpieces to improve performance of the system. Each of the paddles comprises an opposed pair of elongated elements having a triangular prismatic or semi-cylindrical shape. The flat side of one of the elements moves just above the workpiece in parallel relation.

In U.S. Pat. No. 5,516,412, an electroplating system circulates solution between a vertically disposed anode and a workpiece cathode. The workpiece cathode is mounted on a wall of system and the anode is on an opposite wall. A vertically-oriented paddle is reciprocated in an upright position between the terminals immediately adjacent to the cathode workpiece to improve performance of the system. In this design, the paddle comprises an opposed pair of elongated prisms wherein the flat side of one of the prisms moves just above the workpieces in parallel relation. Although these systems are workable, an improved electroplating system is desirable.

SUMMARY OF THE INVENTION

An electroplating system circulates solution between an anode and a workpiece mounted to a cathode. A shaped agitation paddle is reciprocated immediately adjacent to the cathode workpiece to improve performance of the system. The paddle is an elongated prism or other elongated shape having a generally flat side that is parallel to the workpiece. The flat side has a fluid port connected to a pump. The solution may be pumped with either positive pressure to force the solution against the surface of the workpiece, or negative pressure to draw the solution away from the surface of the workpiece. In an alternate embodiment, the cathode workpiece is rotated in the solution above an anode with a stationary, shaped paddle in between them.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 1 is a schematic side view of a first embodiment of an electroplating cell having an agitation paddle constructed in accordance with the invention.

FIG. 2 is a side view of a second embodiment of the paddle of FIG. 1.

FIG. 3 is a side view of a third embodiment of the paddle of FIG. 1.

BEST MODE FOR CARRYING OUT THE INVENTION

Figure 4:
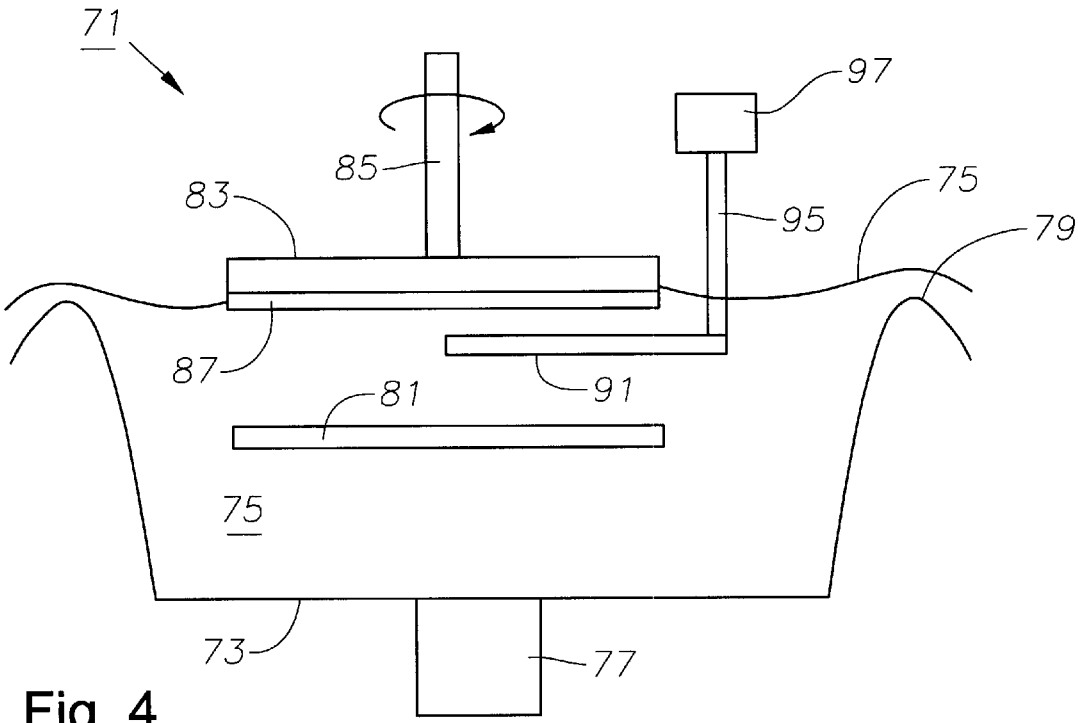
FIG. 4 is a schematic side view of a fourth embodiment of the paddle and electroplating cell of FIG. 1.

Referring to FIG. 1, an electroplating cell assembly 11 for electroplating a flat workpiece 13, such as a wafer with IC chip patterns, is shown. Assembly 11 is tank or box-like in shape and has a lateral cathode wall 15, a lateral anode wall 17, and a plurality of end walls 19 for containing a metallic or alloy electrolyte solution 21 therein. Workpiece 13 is mounted flush in cathode wall 15, which is parallel to anode wall 17. A suitable thief 23 laterally surrounds workpiece 13 and is preferably coplanar therewith to define a conventional cathode for use in electroplating workpiece 13. An anode 25 is mounted to or supported by the anode wall 17. Note that assembly 11 may comprise either a horizontal or vertical plating cell, as are known in the prior art.

Assembly 11 contains an elongated agitation paddle 31 with a generally triangular cross-sectional shape. Paddle 31 is shown disproportionately large relative to assembly 11 for ease of understanding the invention. Paddle 31 is movably mounted in a reciprocating, linear movement relative to workpiece 13 and thief 23 such that its hypotenuse surface 33 maintains a substantially parallel orientation to cathode wall 15 at all times. The arrows in FIG. 1 illustrate the directions of lateral movement for paddle 31 which is motivated by a drive mechanism 34 (shown schematically in FIG. 1).

Paddle 31 also contains a fluid delivery chamber 35 which extends throughout its axial length (into the page). A fluid delivery port 37 is in fluid communication with chamber 35 and extends to the hypotenuse surface 33 of paddle 31. In the embodiment shown, port 37 is an elongated, generally rectangular slot that is flush with surface 33 and perpendicular to workpiece 13. Paddle 31 and port 37 are long enough to cover the entire inner surface of cathode wall 15 in the axial direction. One end of an extensible fluid delivery conduit 39 is interconnected to chamber 35. The other end of conduit 39 is connected to a pump 41 which is mounted adjacent to assembly 11. Conduit 39 is adapted to accommodate the lateral, side-to-side movement of paddle 31. Pump 41 is provided for pumping fluid to or from paddle 31.

The main supply of electrolyte 21 is preferably controlled in terms of temperature, pH, concentration, etc., but is not so limited. In addition, electrolyte 21 may be circulated through the tank, or remain stagnant. In one embodiment, electrolyte 21 is provided into the tank through wall 22 via an opening or perforated area. Electrolyte 21 exits the tank through wall 22 via similar means. Alternatively, electrolyte 21 may be supplied through an opening or perforated anode 25, or an opening or perforated wall 17. In this version, electrolyte 21 could exit through an opening or perforations in wall 22, wall 24, or cathode thief 23.

In operation, workpiece 13 and the surrounding thief 23 are coextensively aligned with anode 25 such that electrical current flux is conducted through the electrolyte 21. As paddle 31 makes lateral passes across the inner surface of cathode wall 15, electrolyte 21 is pumped by pump 41, through conduit 39, chamber 35, and port 37, and against workpiece 13 and thief 23 as a jet of solution. Alternatively, pump 41 is configured to remove or evacuate some of the electrolytic solution 21 lying between paddle 31 and the inner surface of cathode wall 15. In either pumping direction, the fluid boundary layer and gas generation characteristics may be reduced or expanded as desired. The rate of solution delivery or evacuation also may be varied according to need to provide superior uniformity in both thickness and composition of plating on workpiece 13.

For example, in plating dual species materials where two different mechanisms exist for plating (e.g. bulk diffusion or local depletion), adjusting current flow typically controls one species stronger than the other. Agitation, which directly affects the plating thickness of the diffusion-limited boundary layer above the plating film, is typically used to control the other of the species. Use of paddle 31 allows more precise control of plating composition in alloy plating and can result in higher plating rates with alloy or single species plating.

A second embodiment of the invention is shown in FIG. 2 as agitation paddle 51. Paddle 51 is very similar to paddle 31, except that is has an elongated, concave recess 53 in its hypotenuse surface 55. Recess 53 extends along the length of paddle 51. A fluid delivery port 57 extends between recess 53 and an internal chamber 59 in paddle 51. Conduit 39 and pump 41 are connected to paddle 51 and operate in the same manner as described for paddle 31. The use of "shaped" paddle 51 varies the localized delivery or removal of solution 21 to further enhance uniformity in both thickness and composition of plating on workpiece 13.

Referring now to FIG. 3, a third embodiment of the invention is shown as agitation paddle 61. Paddle 61 is also very similar to paddle 31, except that its fluid delivery port 63 in its hypotenuse surface 65 extends diagonally away from its chamber 67. On the other hand, ports 37 (FIG. 1) and 57 (FIG. 2) exchange solution in a direction that is normal to workpiece 13. When it is discharged, the jet strikes workpiece 13 at an acute angle that may be less than 45 degrees. Conduit 39 and pump 41 are connected to paddle 61 and operate in the same manner as described above. The angle of port 63, relative to workpiece 13, provides additional flexibility in enhancing or reducing the solution boundary layer (depending on the pumping direction of the solution) in assembly 11. Port 63 is also elongated, extending along the length of paddle 61.

A fourth embodiment of the invention is shown in FIG. 4 as an electroplating cell assembly 71. Assembly 71 has a basin 73 containing a solution of electrolyte 75. The electrolyte 75 is pumped into basin 73 through a fluid inlet 77 in the bottom and overflows the upper end 79 of basin 73 such that it is continually refreshed in basin 73. Assembly 71 also has an anode 81 and a rotary cathode 83 that are mounted in parallel, aligning relationship relative to one another and separated by a fixed distance. Axle 85 rotates cathode 83 in a plane that is parallel to anode 81, as shown. A circular plating workpiece 87 is mounted substantially flush with the lower surface of cathode 83 for rotation therewith and contacts electrolyte 75 at its upper surface. In operation, the lower surface of workpiece 87 is completely submerged in solution and is in a parallel plane to anode 81 and cathode 83. Although it is not shown, cathode 83 may be readily configured with a thief to laterally surround workpiece 87.

Assembly 71 also has a stationary agitation paddle 91 submerged in electrolyte 75 and mounted between anode 81 and workpiece 85. Paddle 91 is an elongated, generally rectangular member that is fixed in a radial direction relative to the axis of rotation of workpiece 87. Paddle 91 extends from a point beyond the outer diameter of workpiece 87 to near its radial center. Paddle 91 is located in a plane parallel anode 81 and workpiece 85.

Figure 5:
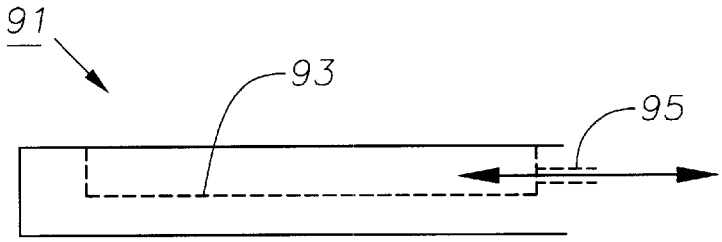
FIG. 5 is an enlarged schematic side view of the paddle of FIG. 4.
Figure 6:
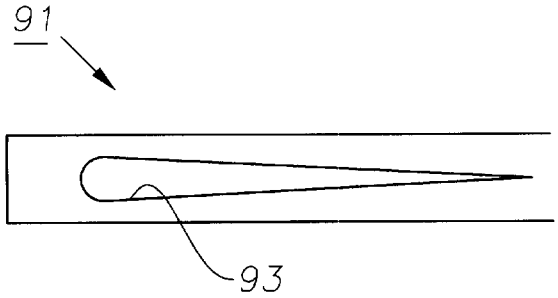
FIG. 6 is an enlarged schematic top view of the paddle of FIG. 4.

As shown in FIGS. 5 and 6, paddle 91 has an elongated, tear drop-like opening or recess 93 in its upper surface which faces workpiece 85. Recess 93 is larger near its distal end and smaller or narrower near its proximal end. Thus, the flow area of recess 93 is larger near the axis of rotation of workpiece 85 and decreases in a radially outward direction. This configuration allows more solution to be delivered to workpiece 85 near its axis of rotation, and less near its perimeter.

A fluid delivery chamber 95 extends through paddle 91 and is interconnected to a pump 97. Like the previous embodiments, pump 97 is configured to either discharge into basin 73 or evacuate some of the electrolytic solution 75 lying between paddle 91 and workpiece 85. In either pumping direction, the boundary layer and alter gas generation characteristics may be expanded or reduced as desired. The rate of solution delivery or evacuation also may be varied according to need to provide superior uniformity in both thickness and composition of plating on workpiece 85. Naturally, openings with other shapes such as an hourglass shape or a plurality of non-uniform openings (different sizes and/or shapes) can be utilized to achieve non-uniform fluid flow.

The invention has several advantages. The delivery or evacuation of solution along the axis of the agitation paddle enhances the uniformity of plating thickness and composition. The enhanced control of the fluid boundary layer of the solution at the workpiece can also provide higher plating rates with single or alloy plating species. Moreover, the shape of the fluid delivery ports and the fluid delivery rate may be readily adapted to further refine the performance of the paddle. In addition, the shape of the paddle and its surface adjacent to the workpiece may be configured for additional flexibility. The rotary cathode and stationary paddle provide additional enhancements to the plating performance. In effect, an infinite variety of paddle shapes and speeds can be simulated with the invention.

While the invention has been shown or described in only some of its forms, it should be apparent to those skilled in the art that it is not so limited, but is susceptible to various changes without departing from the scope of the invention.

We claim:

1. An assembly for electroplating a substantially planar workpiece, comprising:

a cell for containing a volume of electrolyte solution;

an anode positioned in the cell;

a cathode positioned in the cell and having a surface adapted to support the workpiece in the cell;

an agitation paddle positioned in the cell between the cathode and the anode, and having an interior fluid delivery chamber and a paddle surface that is substantially parallel to and facing the cathode;

at least one port in the paddle surface;

a pump in fluid communication with the paddle for moving solution through the interior fluid delivery chamber and the port; and wherein one of the cathode and the paddle moves relative to the other.

2. The assembly of claim 1 wherein the cathode moves relative to the paddle.

3. The assembly of claim 1 wherein the cathode rotates relative to the paddle in a plane that is substantially parallel to the paddle surface.

4. The assembly of claim 1 wherein the paddle moves relative to the cathode in a reciprocating linear movement that is substantially parallel to the cathode.

5. The assembly of claim 1 wherein each of the paddle and the port has a length that are substantially equal to one another.

6. The assembly of claim 1 wherein the port is substantially perpendicular relative to the cathode.

7. The assembly of claim 1 wherein the port is inclined relative to the cathode.

8. The assembly of claim 1 wherein the port is generally concave in shape.

9. The assembly of claim 1 is wherein the port has a shape that is selected from the group consisting of tear drop and hourglass.

10. The assembly of claim 1 wherein the paddle is substantially triangular in cross-section.

11. The assembly of claim 1 wherein the paddle is substantially rectangular in cross-section.

12. The assembly of claim 1, further comprising an extensible conduit mounted to and extending between the pump and the paddle, the conduit accommodating movement of the paddle relative to the cathode.

13. The assembly of claim 1 wherein the pump discharges solution through the port.

14. The assembly of claim 1 wherein the pump evacuates solution through the port.

15. The assembly of claim 1 wherein the port comprises a plurality of non-uniform openings.

16. An assembly for electroplating a substantially planar workpiece, comprising:

a cell for containing a volume of electrolyte solution;

an anode mounted to the cell and having an anode surface;

a cathode mounted to the cell and having a cathode surface opposite and parallel to the anode surface, the cathode adapted to support a workpiece mounted to and substantially flush with the cathode surface;

an agitation paddle mounted in the cell and being movable relative to the cathode, the paddle having an interior fluid delivery chamber and a paddle surface that is substantially parallel to and facing the cathode surface;

a port in the paddle extending along a length of the paddle surface;

a pump for moving fluid through the interior fluid delivery chamber and the port; and an extensible conduit mounted to and extending between the pump and the interior fluid delivery chamber in the paddle, the conduit accommodating reciprocal motion of the paddle relative to the cathode in a plane that is parallel to the cathode surface.

17. The assembly of claim 16 wherein the port is substantially perpendicular relative to the cathode surface.

18. The assembly of claim 16 wherein the port is at an acute angle relative to the cathode surface.

19. The assembly of claim 16 wherein the port is generally concave in shape.

20. The assembly of claim 16 wherein the paddle is substantially triangular in cross-section.

21. The assembly of claim 16 wherein the pump discharges solution through the port.

22. The assembly of claim 16 wherein the pump evacuates solution through the port.

23. The assembly of claim 16 is wherein the port has a shape that is selected from the group consisting of tear drop and hourglass.

24. The assembly of claim 16 wherein the port comprises a plurality of non-uniform openings.

25. An electroplating assembly, comprising:

a container having a volume of electrolytic solution;

an anode submerged in the solution in a substantially horizontal orientation;

a rotatable cathode located above and parallel to the anode, wherein a substantially planar workpiece is adapted to be mounted to the cathode;

a stationary agitation paddle located between the anode and the cathode, the paddle having an interior fluid delivery chamber with a port that faces the cathode surface, and a paddle surface that is substantially parallel to and facing the cathode; and a pump in direct fluid communication with the paddle for moving solution through the interior fluid delivery chamber and the port.

26. The assembly of claim 25 wherein the port is generally tear drop in shape.

27. The assembly of claim 25 wherein the port has an increasing flow area in a direction toward an axis of rotation of the cathode.

28. The assembly of claim 25 wherein the pump discharges solution through the port.

29. The assembly of claim 25 wherein the pump evacuates solution through the port.

* * * * *